US011804159B2

(12) United States Patent
Liu

(10) Patent No.: US 11,804,159 B2
(45) Date of Patent: Oct. 31, 2023

(54) TIMING CONTROLLER, CLOCK RESET METHOD, AND DISPLAY PANEL

(71) Applicant: TCL CHINA STAR OPTOELECTRONICS TECHNOLOGY CO., LTD., Shenzhen (CN)

(72) Inventor: Jinfeng Liu, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 156 days.

(21) Appl. No.: 17/434,005

(22) PCT Filed: May 31, 2021

(86) PCT No.: PCT/CN2021/097292
§ 371 (c)(1),
(2) Date: Aug. 25, 2021

(87) PCT Pub. No.: WO2022/147955
PCT Pub. Date: Jul. 14, 2022

(65) Prior Publication Data

US 2023/0138499 A1 May 4, 2023

(30) Foreign Application Priority Data

Jan. 7, 2021 (CN) ..... 202110016198.2

(51) Int. Cl.
*G09G 3/20* (2006.01)

(52) U.S. Cl.
CPC ..... *G09G 3/20* (2013.01); *G09G 2310/08* (2013.01); *G09G 2330/12* (2013.01)

(58) Field of Classification Search
CPC ... G09G 3/20; G09G 2310/08; G09G 2330/12
See application file for complete search history.

(56) References Cited

U.S. PATENT DOCUMENTS

2011/0037758 A1 2/2011 Lim
2017/0116954 A1 4/2017 Baek
2020/0175912 A1* 6/2020 Lee ..... G09G 3/3225
(Continued)

FOREIGN PATENT DOCUMENTS

CN 1975523 A 6/2007
CN 101470501 A 7/2009
CN 106782410 A 5/2017
(Continued)

*Primary Examiner* — Sejoon Ahn
(74) *Attorney, Agent, or Firm* — PV IP PC; Wei Te Chung; Zhigang Ma

(57) ABSTRACT

A timing controller, a clock reset method, and a display panel are provided. When an abnormal working condition occurs in a transition stage of recovering a reset control signal from a jumping state to an initial state, the problem that a clock of the timing controller cannot be synchronized can be avoided when a processing module cannot normally output a clock reset pulse signal and a clock data recovering module cannot normally recover the clock of the timing controller because the reset control signal is in the jumping state. Reliability of the timing controller is increased.

15 Claims, 6 Drawing Sheets

(56) References Cited

U.S. PATENT DOCUMENTS

| | | | | |
|---|---|---|---|---|
| 2020/0301518 | A1* | 9/2020 | Lee | G09G 5/005 |
| 2021/0342055 | A1* | 11/2021 | Hirai | G06F 3/0446 |

FOREIGN PATENT DOCUMENTS

| | | | |
|---|---|---|---|
| CN | 111326098 | A | 6/2020 |
| CN | 111404543 | A | 7/2020 |
| CN | 111986603 | A | 11/2020 |
| CN | 112837644 | A | 5/2021 |

* cited by examiner

TIMING CONTROLLER, CLOCK RESET METHOD, AND DISPLAY PANEL

RELATED APPLICATIONS

This application is a Notional Phase of PCT Patent Application No. PCT/CN2021/097292 having international filing date of May 31, 2021, which claims the benefit of priority of Chinese Patent Application No. 202110016198.2 filed on Jan. 7, 2021. The contents of the above applications are all incorporated by reference as if fully set forth herein in their entirety.

TECHNICAL FIELD

The present disclosure relates to the display technology field, and more particularly to a timing controller, a clock reset method, and a display panel.

BACKGROUND ART

A timing controller of a display panel needs to be restarted when detecting an error or abnormality in a system. When the timing controller is started every time, a clock of the timing controller needs to be recovered to retrain links to synchronize a clock of the entire system. Therefore, whether the timing controller can normally complete a clock data recovering operation when being restarted plays a vital role for the stability and reliability of the timing controller and the display panel.

Currently, the timing controller cannot normally output a clock reset pulse signal when the timing controller is consecutively restarted for a plurality of times due to abnormal working conditions. As such, the clock of the timing controller cannot be recovered normally, and an abnormal phenomenon occurs in an image of the display panel.

Therefore, it is necessary to propose a new timing controller and a clock reset method for the timing controller, so that when the timing controller has multiple consecutive starts, the clock recovering signal can be normally output every time the timing controller is started, so that the entire system Clock synchronization.

Technical Problem

Currently, the timing controller cannot normally output a clock reset pulse signal when the timing controller is consecutively restarted for a plurality of times due to abnormal working conditions. As such, the clock of the timing controller cannot be recovered normally, and an abnormal phenomenon occurs in an image of the display panel.

Technical Solution

In order to solve the above-mentioned problem, embodiments of the present disclosure provide a timing controller, a clock reset method, and a display panel.

In a first aspect, one embodiment of the present disclosure provides a timing controller. The timing controller includes a detecting module, a processing module, and a clock data recovering module which are sequentially connected. The detecting module is configured to output a reset control signal in an initial state in response to a normal working condition of the timing controller and configured to output the reset control signal in a jumping state in response to an abnormal working condition of the timing controller. The processing module is configured to generate a clock reset pulse signal according to the reset control signal in the jumping state and configured to recover the reset control signal from the jumping state to the initial state in response to an end of a pulse of the clock reset pulse signal. The clock data recovering module is configured to recover a clock of the timing controller according to the clock reset pulse signal.

In some embodiments, the detecting module includes a detecting unit and a reset unit which are connected to each other. The detection unit is configured to detect a working state of the timing controller and configured to output the reset control signal in the initial state when the timing controller is working normally. The reset unit is configured to reverse the reset control signal from the initial state to the jumping state when the detecting unit detects the abnormal working condition of the timing controller.

In some embodiments, the processing module includes a processing unit, a delaying and reversing unit, and a logic gate unit. An input terminal of the processing unit is connected to an output terminal of the detecting module, an output terminal of the processing unit is connected to an input terminal of the delaying and reversing unit and a first input terminal of the logic gate unit, and a second input terminal of the logic gate unit is connected to an output terminal of the delaying and reversing unit. The processing unit is configured to detect a state of the reset control signal and a state of the clock reset pulse signal, and configured to recover the reset control signal from the jumping state to the initial state after a pulse of the clock reset pulse signal ends and before the reset control signal is recovered from the jumping state to the initial state. The delaying and reversing unit is configured to delay the reset control signal for a preset period of time and configured to perform a reverse operation to obtain a delayed and reversed reset control signal. The logic gate unit is configured to perform a corresponding logic operation according to the reset control signal and the delayed and reversed reset control signal and configured to output the clock reset pulse signal, wherein a pulse width of the clock reset pulse signal is a preset duration.

In some embodiments, a voltage level of the reset control signal in the initial state is a high voltage level, a voltage level of the reset control signal in the jumping state is a low voltage level, and a logic gate unit of the processing module is an OR gate.

In some embodiments, a voltage level of the reset control signal in the initial state is a low voltage level, a voltage level of the reset control signal in the jumping state is a high voltage level, and a logic gate unit of the processing module is an AND gate.

In a second aspect, one embodiment of the present disclosure further provides a clock reset method of a timing controller. The timing controller includes a detecting module, a processing module, and a clock data recovering module which are sequentially connected. The clock reset method includes: outputting a reset control signal in an initial state the detecting module in response to a normal working condition of the timing controller, and outputting the reset control signal in a jumping state the detecting module in response to an abnormal working condition of the timing controller; generating a clock reset pulse signal by the processing module according to the reset control signal in the jumping state, and recovering the reset control signal from the jumping state to the initial state by the processing module in response to an end of a pulse of the clock reset pulse signal; and recovering a clock of the timing controller by the clock data recovering module according to the clock reset pulse signal.

In some embodiments, the processing module includes a processing unit, a delaying and reversing unit, and a logic gate unit. An input terminal of the processing unit is connected to an output terminal of the detecting module, an output terminal of the processing unit is connected to an input terminal of the delaying and reversing unit and a first input terminal of the logic gate unit, and a second input terminal of the logic gate unit is connected to an output terminal of the delaying and reversing unit. the generating the clock reset pulse signal by the processing module according to the reset control signal in the jumping state includes: outputting the reset control signal by the processing unit; delaying the reset control signal for a preset period of time by the delaying and reversing unit, and performing a reverse operation on reset control signal by the delaying and reversing unit to obtain a delayed and reversed reset control signal; and performing a corresponding logic operation by the logic gate unit according to the reset control signal and the delayed and reversed reset control signal, and outputting the clock reset pulse signal when the reset control signal is reversed from the initial state to the jumping state, where a pulse width of the clock reset pulse signal is a preset duration.

In some embodiments, the processing unit includes a detecting sub-unit and a recovering sub-unit which are connected to each other. The recovering the reset control signal from the jumping state to the initial state by the processing module in response to the end of the pulse of the clock reset pulse signal includes: detecting a state of the reset control signal and a state of the clock reset pulse signal by the detection unit; and recovering the reset control signal from the jumping state to the initial state by the recovering sub-unit after the pulse of the clock reset pulse signal ends and before the reset control signal is recovered from the jump state to the initial state.

In some embodiments, a voltage level of the reset control signal in the initial state is a high voltage level, a voltage level of the reset control signal in the jumping state is a low voltage level, and a logic gate unit of the processing module is an OR gate.

In some embodiments, a voltage level of the reset control signal in the initial state is a low voltage level, a voltage level of the reset control signal in the jumping state is a high voltage level, and a logic gate unit of the processing module is an AND gate.

In a third aspect, one embodiment of the present disclosure further provides a display panel. The display panel includes at least one timing controller. The timing controller includes a detecting module, a processing module, and a clock data recovering module which are sequentially connected. The detecting module is configured to output a reset control signal in an initial state in response to a normal working condition of the timing controller and configured to output the reset control signal in a jumping state in response to an abnormal working condition of the timing controller. The processing module is configured to generate a clock reset pulse signal according to the reset control signal in the jumping state and configured to recover the reset control signal from the jumping state to the initial state in response to an end of a pulse of the clock reset pulse signal. The clock data recovering module is configured to recover a clock of the timing controller according to the clock reset pulse signal.

In some embodiments, the detecting module includes a detecting unit and a reset unit which are connected to each other. The detection unit is configured to detect a working state of the timing controller and configured to output the reset control signal in the initial state when the timing controller is working normally. The reset unit is configured to reverse the reset control signal from the initial state to the jumping state when the detecting unit detects the abnormal working condition of the timing controller.

In some embodiments, the processing module includes a processing unit, a delaying and reversing unit, and a logic gate unit. An input terminal of the processing unit is connected to an output terminal of the detecting module, an output terminal of the processing unit is connected to an input terminal of the delaying and reversing unit and a first input terminal of the logic gate unit, and a second input terminal of the logic gate unit is connected to an output terminal of the delaying and reversing unit. The processing unit is configured to detect a state of the reset control signal and a state of the clock reset pulse signal, and configured to recover the reset control signal from the jumping state to the initial state after a pulse of the clock reset pulse signal ends and before the reset control signal is recovered from the jumping state to the initial state. The delaying and reversing unit is configured to delay the reset control signal for a preset period of time and configured to perform a reverse operation to obtain a delayed and reversed reset control signal. The logic gate unit is configured to perform a corresponding logic operation according to the reset control signal and the delayed and reversed reset control signal and configured to output the clock reset pulse signal, wherein a pulse width of the clock reset pulse signal is a preset duration.

In some embodiments, the processing unit includes a detecting sub-unit and a recovering sub-unit. The detecting sub-unit is configured to detect the state of the reset control signal and the state of the clock reset pulse signal. The recovering sub-unit is configured to recover the reset control signal from the jumping state to the initial state after the detecting sub-unit detects that the pulse of the clock reset pulse signal ends and before the detecting sub-unit detects that the reset control signal is recovered from the jump state to the initial state.

In some embodiments, a voltage level of the reset control signal in the initial state is a high voltage level, a voltage level of the reset control signal in the jumping state is a low voltage level, and a logic gate unit of the processing module is an OR gate.

In some embodiments, a voltage level of the reset control signal in the initial state is a low voltage level, a voltage level of the reset control signal in the jumping state is a high voltage level, and a logic gate unit of the processing module is an AND gate.

Advantageous Effects

The embodiments of the present disclosure provide a timing controller, a clock reset method, and a display panel. In the timing controller, the detecting module is configured to output the reset control signal in the initial state when the timing controller is working normally, and the detecting module is configured to output the reset control signal in the jumping state when the timing controller is working abnormally. Then, the processing module is configured to output the clock reset pulse signal according to the reset control signal which is changed from the initial state to the jumping state, and the processing module is configured to recover the reset control signal from the jumping state to the initial state after the pulse of the clock reset pulse signal ends. Finally, the clock data recovering module is configured to recover the clock of the timing controller according to the clock reset pulse signal.

In the timing controller, the processing module can immediately advance to recover the reset control signal from the jumping state to the initial state after the pulse of the clock reset pulse signal outputted by the processing module ends. When the abnormal working condition of the timing controller occurs, the clock reset pulse signal can be outputted normally and the clock data recovering module can recover the clock of the timing controller. As such, when the abnormal working condition of the timing controller occurs in the transition stage of recovering the reset control signal from the jumping state to the initial state, the problem that the clock of the timing controller cannot be synchronized can be avoided when the processing module cannot normally output the clock reset pulse signal and the clock data recovering module cannot normally recover the clock of the timing controller because the reset control signal is in the jumping state. Reliability of the timing controller is increased.

BRIEF DESCRIPTION OF DRAWINGS

FIG. 7(*b*) illustrates a first timing diagram of the timing controller provided by one embodiment of the present disclosure.

FIG. 8(*b*) illustrates a second timing diagram of the timing controller provided by one embodiment of the present disclosure.

DETAILED DESCRIPTION OF EMBODIMENTS

To make the objectives, technical schemes, and technical effects of the present disclosure more clearly and definitely, the present disclosure will be described in details below by using embodiments in conjunction with the appending drawings. It should be understood that the specific embodiments described herein are merely for explaining the present disclosure but are not intended to limit the present disclosure.

Figure 1:
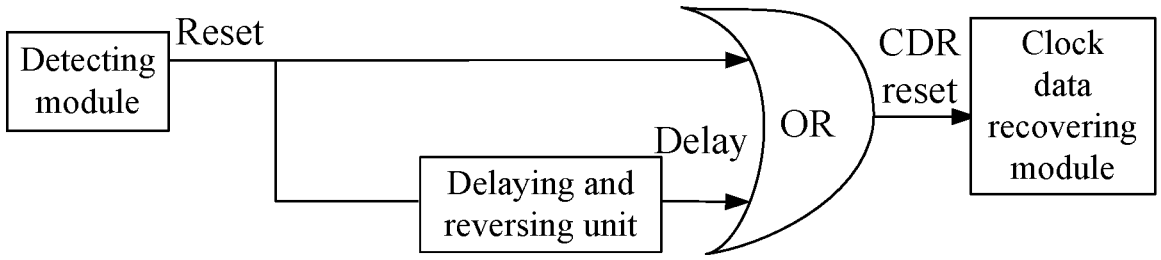
FIG. 1 illustrates a structural diagram of a clock data recovering circuit of a timing controller in the prior art.
Figure 2:
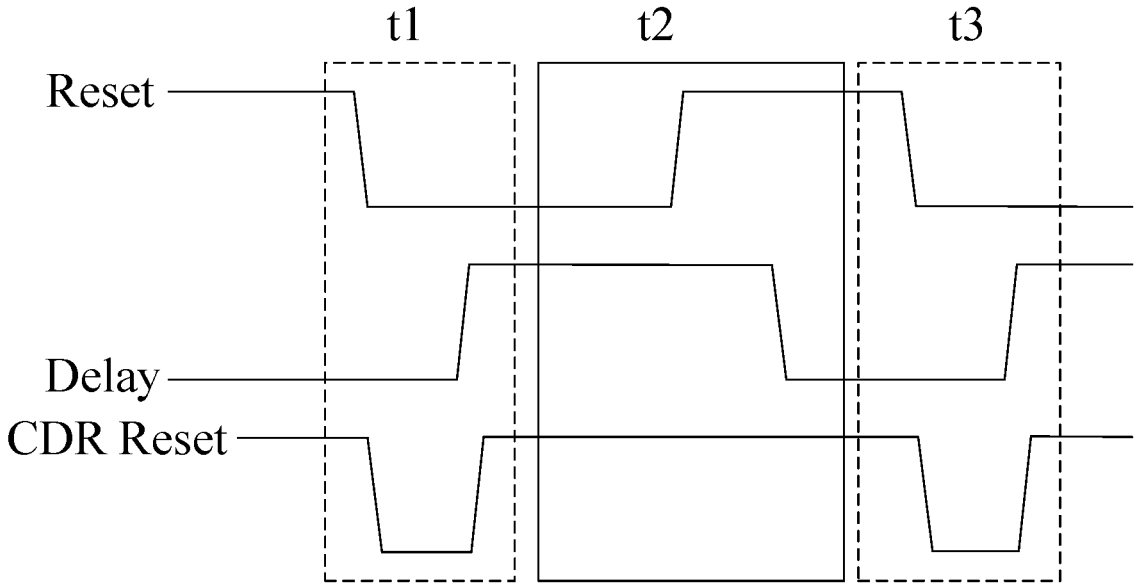
FIG. 2 illustrates a timing diagram of the clock data recovering circuit of the timing controller in the prior art.

In a timing controller, a main function of a clock data recovering operation is to extract a data sequence from received signals and to recover a clock timing signal corresponding to the data sequence, thereby restoring the received specific information to synchronize the clock of the timing controller with a system. FIG. 1 illustrates a structural diagram of a clock data recovering circuit of a timing controller in the prior art. FIG. 2 illustrates a timing diagram of the clock data recovering circuit of the timing controller in the prior art. As shown in FIGS. 1 and 2, a clock data recovering mechanism of the conventional timing controller is to detect a working state of the timing controller via a detecting module and to output a reset control signal Reset in an initial state when the timing controller is working normally. Then, an OR operation is performed on the reset control signal Reset and a delayed and reversed reset control signal Delay, which is delayed and reversed, to output a clock reset pulse signal CDR reset to inform the clock data recovering module to recover the clock of the timing controller, thereby retraining links to synchronize the clock of the timing controller with the system. Then, after the detecting module detects that the timing controller is recovered to a normal operation (usually after a pulse of the clock reset pulse signal CDR reset ends), the reset control signal Reset is recovered from a low voltage level to a high voltage level in the initial state until the timing controller is restarted next time and the clock reset pulse signal CDR reset is normally output, thereby recovering the normal clock of the timing controller. That is, when an abnormality is detected every time, the reset control signal Reset is switched from the high voltage level in the initial state to the low voltage level.

However, when the timing controller is started twice due to an abnormal working condition or under manual control, that is, an abnormal start (t2 stage) exists between a first normal start (t1 stage) and a second normal start (t3 stage), the reset control signal Reset is not recovered to the high voltage level in the initial state after the first normal start because a time interval between the second normal start (t3 stage) and the first normal start (t1 stage) is very short. In the process of the abnormal start (t2 stage), the reset control signal Reset is in a transition stage from low voltage level to the high voltage level, which causes the clock reset pulse signal CDR Reset cannot be output normally (the CDR reset signal cannot be output in t2 stage). Accordingly, the clock data recovering operation fails. The clock of the timing controller is not synchronized with the system. The state of the timing controller is unstable, and thus an abnormal phenomenon occurs in an image of a display panel.

Figure 3:
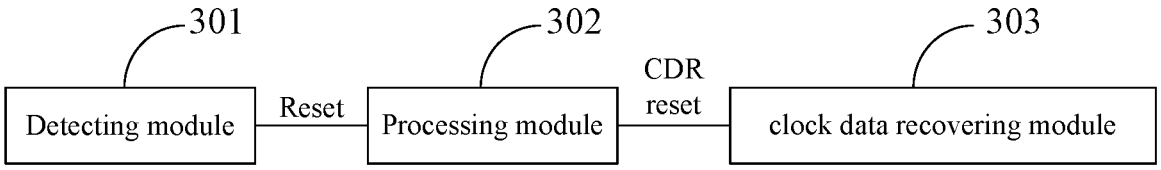
FIG. 3 illustrates a structural diagram of a timing controller provided by one embodiment of the present disclosure.

In order to solve the above problems, FIG. 3 illustrates a structural diagram of a timing controller provided by one embodiment of the present disclosure. The timing controller includes a detecting module 301, a processing module 302, and a clock data recovering module 303 which are sequentially connected. Each of the modules is explained in detail as follows.

The detecting module 301 is configured to output a reset control signal Reset in an initial state in response to a normal working condition of the timing controller and configured to output the reset control signal Reset in a jumping state in response to an abnormal working condition of the timing controller.

The abnormal working condition of the timing controller refers to a situation in which abnormal data transmission occurs in the timing controller and the abnormal data transmission lasts for a certain period of time.

Specifically, the detecting module 301 is configured to detect a working state of timing controller and configured to output the reset control signal Reset in the initial state when the timing controller is working normally. When the working state of the timing controller is normal, the reset control signal Reset outputted by the detecting module 301 is maintained in the initial state. When the abnormal working condition of the timing controller occurs, the detecting module 301 is configured to reverse the reset control signal Reset from the initial state to the jumping state.

The processing module 302 is configured to generate a clock reset pulse signal CDR reset according to the reset control signal Reset in the jumping state and configured to recover the reset control signal Reset from the jumping state to the initial state in response to an end of a pulse of the clock reset pulse signal CDR reset.

Specifically, the processing module 302 is configured to monitor a state of the reset control signal Reset. When the reset control signal Reset is changed from the initial state to the jumping state, the processing module 302 is configured to output the clock reset pulse signal CDR reset.

Further, the reset control signal Reset outputted by the detecting module 301 needs a certain self-recovery time to be recovered from the jumping state to the initial state. The processing module 302 can also be configured to advance the reset control signal Reset from the jumping state to the initial state during the self-recovery time, thereby preventing the problem that the clock reset pulse signal CDR reset cannot be output normally when another abnormal working condition of the timing controller occurs during the self-recovery time.

It should be noted that in order not to interfere with the clock reset pulse signal CDR reset outputted in a previous abnormal condition, the operation of advancing to restores the reset control signal Reset from the jumping state to the initial state by the processing module 302 should be performed after the pulse of the clock reset pulse signal CDR ends. That is, the processing module 302 is configured to recover the reset control signal Reset from the jumping state to the initial state after the pulse of the clock reset pulse signal CDR reset ends.

It can be understood that when the reset control signal Reset outputted by the detecting module 301 is always in the initial state without being changed from the initial state to the jumping state, the processing module 302 does not perform any operation on the reset control signal Reset and does not output the clock reset pulse signal CDR reset.

The clock data recovering module 303 is configured to recover a clock of the timing controller according to the clock reset pulse signal CDR reset.

Specifically, the clock data recovering module 303 is a module for recovering the clock of the timing controller. The timing controller recovers the clock of the timing controller via the clock data recovering module 303, so that the clock of the timing controller is synchronized with the system.

It can be understood that when the processing module 302 does not output the clock reset pulse signal CDR reset, the clock data recovering module 303 does not perform the clock data recovering operation.

In the timing controller provided by the embodiment of the present disclosure, the reset control signal Reset outputted by the detecting module 301 can be immediately recovered from the jumping state to the initial state after the pulse of the clock reset pulse signal CDR reset outputted by the processing module 302 ends. Accordingly, when the abnormal working condition occurs, the timing controller can normally output the clock reset pulse signal CDR reset every time and the clock of the timing controller can be recovered by the clock data recovering module 303. As such, when the abnormal working condition of the timing controller occurs in the transition stage (self-recovery time) of recovering the reset control signal Reset from the jumping state to the initial state, the problem that the clock of the timing controller cannot be synchronized can be avoided when the processing module 302 cannot normally output the clock reset pulse signal CDR reset and the clock data recovering module 303 cannot normally recover the clock of the timing controller because the reset control signal Reset is in the jumping state. Reliability of the timing controller is increased.

Figure 4:
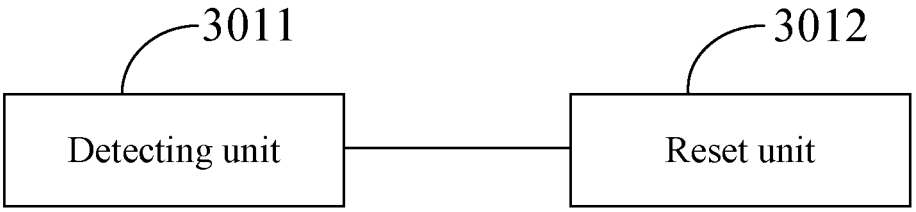
FIG. 4 illustrates a structural diagram of the detecting module of the timing controller provided by one embodiment of the present disclosure.

Based on the above-mentioned embodiment, FIG. 4 illustrates a structural diagram of the detecting module 301 of the timing controller provided by one embodiment of the present disclosure. The detecting module 301 includes a detecting unit 3011 and a reset unit 3012 which are connected to each other.

The detection unit 3011 is configured to detect the working state of the timing controller and configured to output the reset control signal Reset in the initial state when the timing controller is working normally.

The reset unit 3012 is configured to reverse the reset control signal Reset from the initial state to the jumping state when the detecting unit 3011 detects the abnormal working condition of the timing controller.

Specifically, a working process of the detecting module 301 is described as follows. The working state of the timing controller, including whether the abnormal data transmission occurs in the timing controller and duration of the abnormal data transmission, is detected by the detecting unit 3011. When the timing controller is working normally, the detecting unit 3011 is configured to output the reset control signal Reset in the initial state. When the detection unit 3011 detects that the abnormal data transmission occurs in the timing controller and the duration of the abnormal data transmission lasts for a certain period of time, it is determined that the abnormal working condition of the timing controller occurs. At this time, the reset unit 3012 is configured to reverse the reset control signal Reset in the initial state outputted by the detecting unit 3011 into the jump state.

It can be understood that when the detection unit 3011 detects that the timing controller is always in the normal working state and the abnormal working condition does not occur, the reset control signal Reset in the initial state is always outputted. In other words, as long as the detection unit 3011 detects that the timing controller is in the normal working condition, the detection unit 3011 outputs the reset control signal Reset even if the timing controller is changed from the abnormal state to the normal working condition. At this time, the reset unit 3012 does not perform any operation on the reset control signal Reset but directly outputs the reset control signal Reset.

Figure 5:
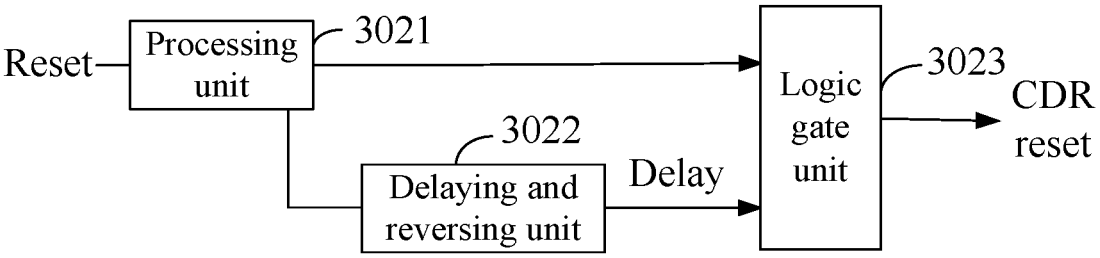
FIG. 5 illustrates a structural diagram of the processing module of the timing controller provided by one embodiment of the present disclosure.

Based on the above-mentioned embodiment, FIG. 5 illustrates a structural diagram of the processing module of the timing controller provided by one embodiment of the present disclosure. The processing module 302 includes a processing unit 3021, a delaying and reversing unit 3022, and a logic gate unit 3023. An input terminal of the processing unit 3021 is connected to an output terminal of the detecting module 301, and an output terminal of the processing unit 3021 is connected to an input terminal of the delaying and reversing unit 3022 and a first input terminal of the logic gate unit 3023. A second input terminal of the logic gate unit 3023 is connected to an output terminal of the delaying and reversing unit 3022.

The processing unit 3021 is configured to detect the state of the reset control signal Reset and a state of the clock reset pulse signal CDR reset, and configured to recover the reset control signal Reset from the jumping state to the initial state after the pulse of the clock reset pulse signal CDR reset ends and before the reset control signal Reset is recovered from the jumping state to the initial state.

The delaying and reversing unit 3022 is configured to delay the reset control signal Reset for a preset period of time and configured to perform a reverse operation to obtain the delayed and reversed reset control signal CDR reset.

The logic gate unit 3023 is configured to perform a corresponding logic operation according to the reset control signal Reset and the delayed and reversed reset control signal Delay and configured to output the clock reset pulse signal CDR reset, where a pulse width of the clock reset pulse signal CDR reset is a preset duration.

Specifically, a working process of the processing module 302 is described as follows. The processing unit 3021 is configured to process the reset control signal Reset and then configured to output the processed reset control signal Reset. The delaying and reversing unit 3022 is configured to delay the reset control signal Reset for the preset period of time and configured to perform the reverse operation to obtain the delayed and reversed reset control signal Delay. Finally, the logic gate unit 3023 is configured to perform the logic operation to obtain the clock reset pulse signal CDR reset. It can be understood that the pulse width of the clock reset pulse signal CDR reset is the preset period of time for which the reset control signal Reset is delayed.

A process of the processing unit 3021 on the reset control signal Reset is specifically described as follows. When the processing unit 3021 detects that the pulse of the clock reset pulse signal CDR reset ends and the reset control signal Reset is not recovered from the jumping state to the initial state, the processing unit 3021 is configured to recover the reset control signal Reset from the jumping state to the initial state. It can be understood that when the processing unit 3021 does not detect a trigger condition that the pulse of the clock reset pulse signal CDR reset ends and the reset control signal Reset is not recovered from the jumping state to the initial state, the reset control signal Reset is not changed but is directly outputted.

Figure 6:
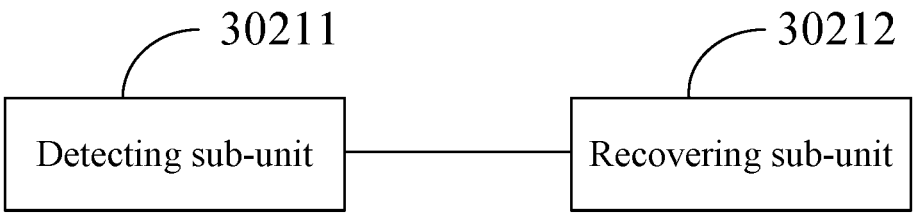
FIG. 6 illustrates a structural diagram of the processing unit of the processing module of the timing controller provided by one embodiment of the present disclosure.

Based on the above-mentioned embodiment, FIG. 6 illustrates a structural diagram of the processing unit of the processing module of the timing controller provided by one embodiment of the present disclosure. The processing unit 3021 includes a detecting sub-unit 30211 and a recovering sub-unit 30212.

The detecting sub-unit 30211 is configured to detect the state of the reset control signal Reset and the state of the clock reset pulse signal CDR reset.

The recovering sub-unit 30212 is configured to recover the reset control signal Reset from the jumping state to the initial state after the detecting sub-unit 30211 detects that the pulse of the clock reset pulse signal CDR reset ends and before the detecting sub-unit 30211 detects that the reset control signal Reset is recovered from the jump state to the initial state.

Figure 7A:
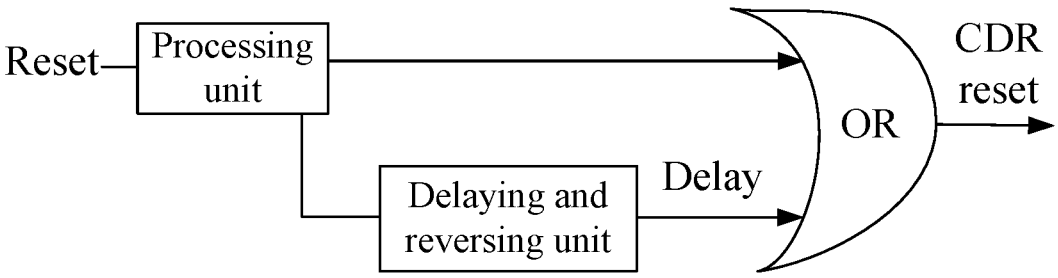
FIG. 7(*a*) illustrates a first specific structural diagram of the processing module of the timing controller provided by one embodiment of the present disclosure.
Figure 7B:
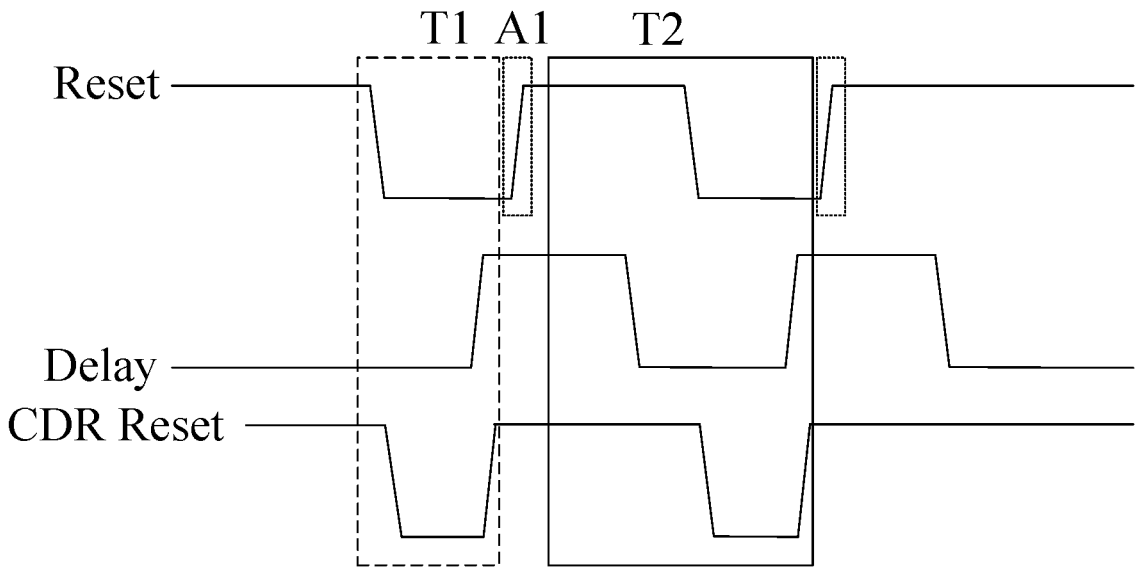

Based on the above-mentioned embodiment, FIG. 7(*a*) illustrates a first specific structural diagram of the processing module of the timing controller provided by one embodiment of the present disclosure. FIG. 7(*b*) illustrates a first timing diagram of the timing controller provided by one embodiment of the present disclosure. In the embodiment of the present disclosure, a voltage level of the reset control signal Reset in the initial state is a high voltage level, and a voltage level in the jumping state is a low voltage level. Correspondingly, a logic gate unit of the processing module 302 is an OR gate.

Refer to FIG. 3 and FIG. 7(*b*). In a T1 stage in FIG. 7(*b*), an abnormal working condition occurs for the first time after the timing controller is started normally. In an A1 stage, the processing module 302 is configured to recover the reset control signal Reset from the jumping state to the initial state after the pulse of the clock reset pulse signal CDR reset ends and before the reset control signal Reset is recovered from the jumping state to the initial state. In a T2 stage, another abnormal working condition occurs for the second time after the timing controller is started normally (that is, the abnormal startup in FIG. 2).

Specifically, a specific process of outputting, based on the detecting module 301, the processing module 302, and the clock data recovering module 303, the reset control signal Reset, the delayed and reversed reset control signal Delay, and the clock reset pulse signal CDR reset by the timing controller is described as follows.

When the reset control signal Reset outputted by the detection module 301 is reversed from the initial state at the high voltage level to the jumping state at the low voltage level, the processing module 302 is configured to delay the reset control signal Reset for the preset period of time and configured to perform the reverse operation to obtain the delayed and reversed reset control signal Delay. Then, the OR operation is performed on the reset control signal Reset and the delayed and reversed reset control signal Delay. When the reset control signal Reset is reversed from the high voltage level to the low voltage level, the delayed and reversed reset control signal Delay is still at the low voltage level. At this time, the clock reset pulse signal CDR reset at the low voltage level is outputted. When the reset control signal Reset is reversed from the low voltage level to the high voltage level, the clock reset pulse signal CDR reset is reversed from the low voltage level to the high voltage. That is, the clock reset pulse signal CDR reset ends because the pulse width of the clock reset pulse signal CDR reset is the preset period of time for which the reset control signal Reset is delayed. Then, the processing module 302 is configured to advance to recover the reset control signal Reset from the low voltage level to the high voltage level (A1 stage) after the pulse of the clock reset pulse signal CDR reset ends and the detecting module 301 does not recover the reset control signal from the low voltage level to the high voltage level. As such, since the reset control signal Reset is still at the low voltage level when the abnormally working condition of the timing controller occurs in the present stage, the situation that the processing module 302 cannot normally output the clock reset pulse signal CDR reset and the clock data recovering module 303 cannot normally recover the clock of the timing controller can be prevented.

Figure 8A:
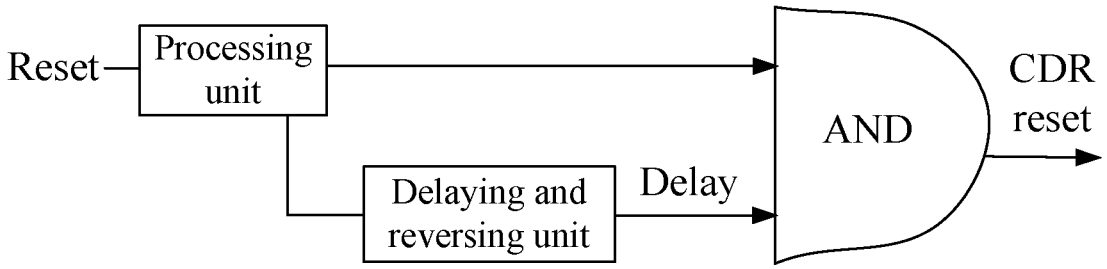
FIG. 8(*a*) illustrates a second specific structural diagram of the processing module of the timing controller provided by one embodiment of the present disclosure.
Figure 8B:
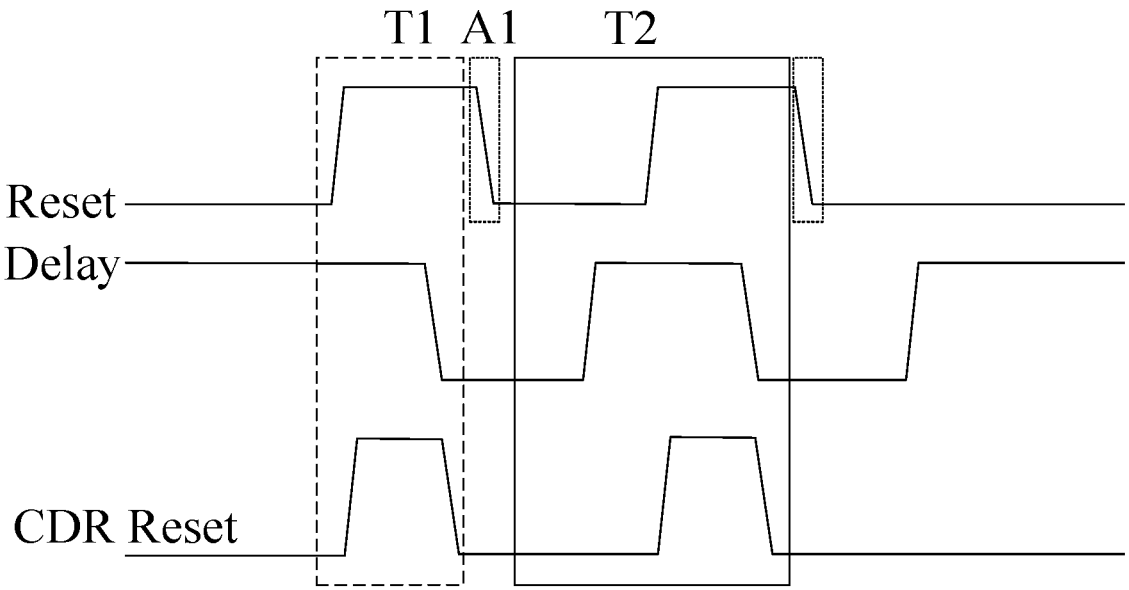

Alternatively, refer to FIG. 8(*a*) and FIG. 8(*b*). FIG. 8(*a*) illustrates a second specific structural diagram of the processing module of the timing controller provided by one embodiment of the present disclosure. FIG. 8(*b*) illustrates a second timing diagram of the timing controller provided by one embodiment of the present disclosure. In the embodiment of the present disclosure, a voltage level of the reset control signal Reset in the initial state is a low voltage level, and a voltage level in the jumping state is a high voltage level. Correspondingly, a logic gate unit of the processing module 302 is an AND gate. In the present embodiment, a detailed process of the timing controller is similar to the above-mentioned embodiment and not repeated herein.

It should be emphasized that each of the delayed and reversed reset control signals Delay in FIG. 7(*b*) and FIG. 8(*b*) is obtained by delaying the reset control signal Reset, and each of the clock reset pulse signals CDR reset is generated by performing the logic operation on the reset control signal Reset and the delayed and reversed reset control signal Delay. Specifically, FIG. 7(*b*) corresponds to the case where the clock reset pulse signal CDR reset is generated by performing the OR operation on the reset control signal Reset and the delayed and reversed reset control signal Delay. Therefore, in FIG. 7(*b*), a starting point of a falling edge of the clock reset pulse signal CDR reset is an ending point of a falling edge of the reset control signal Reset, and a starting point of a rising edge of the clock reset pulse signal CDR reset is an ending point of a rising edge of the delayed and reversed reset control signal Delay. FIG. 8(*b*) corresponds to the case where the clock reset pulse signal CDR reset is generated by performing the AND operation on the reset control signal Reset and the delayed and reversed reset control signal Delay. Therefore, in FIG. 8(*b*), a starting point of a rising edge of the clock reset pulse signal CDR reset is an ending point of a rising edge of the reset control signal Reset, and a starting point of a falling edge of the clock reset pulse signal CDR reset is an ending point of a falling edge of the delayed and reversed reset control signal Delay.

Figure 9:
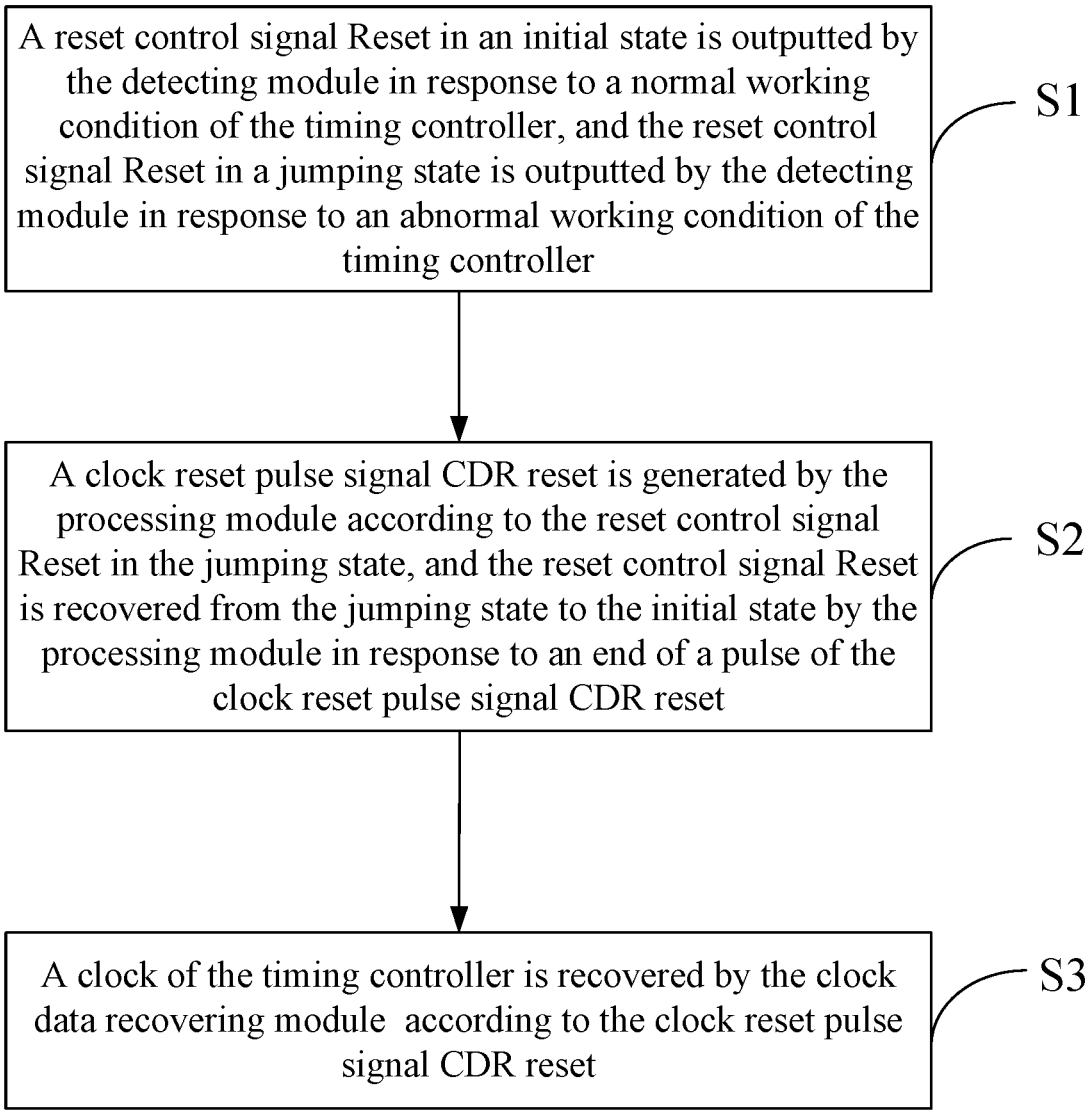
FIG. 9 illustrates a flowchart of a clock reset method of a timing controller provided by one embodiment of the present disclosure.

Based on the above-mentioned embodiment, refer to FIGS. 3 and 9. FIG. 9 illustrates a flowchart of a clock reset method of a timing controller provided by one embodiment of the present disclosure. The timing controller includes a detecting module 301, a processing module 302, and a clock data recovering module 303 which are sequentially connected. The clock reset method includes the following steps.

In S1, a reset control signal Reset in an initial state is outputted by the detecting module 301 in response to a normal working condition of the timing controller, and the reset control signal Reset in a jumping state is outputted by the detecting module 301 in response to an abnormal working condition of the timing controller.

In S2, a clock reset pulse signal CDR reset is generated by the processing module 302 according to the reset control signal Reset in the jumping state, and the reset control signal Reset is recovered from the jumping state to the initial state by the processing module 302 in response to an end of a pulse of the clock reset pulse signal CDR reset.

In S3, a clock of the timing controller is recovered by the clock data recovering module 303 according to the clock reset pulse signal CDR reset.

In the clock reset method of the timing controller provided by the embodiment of the present disclosure, the reset control signal Reset outputted by the detecting module 301 can be immediately recovered from the jumping state to the initial state after the clock reset pulse signal CDR reset is outputted. As such, when the abnormal working condition of the timing controller occurs in the transition stage of recovering the reset control signal Reset from the jumping state to the initial state, the problem that the clock of the timing controller cannot be recovered normally can be avoided when the clock reset pulse signal CDR reset cannot be outputted normally. Reliability of the timing controller is increased. That is, the timing controller can be applied to a situation of consecutively starting of the timing controller for a plurality of times. The timing controller can normally output the clock reset pulse signal CDR reset when the timing controller is started each time after the plurality of times.

Based on the above-mentioned embodiment, refer to FIG. 5. The processing module 302 includes a processing unit 3021, a delaying and reversing unit 3022, and a logic gate unit 3023. An input terminal of the processing unit 3021 is connected to an output terminal of the detecting module 301, and an output terminal of the processing unit 3021 is connected to an input terminal of the delaying and reversing unit 3022 and a first input terminal of the logic gate unit 3023. A second input terminal of the logic gate unit 3023 is connected to an output terminal of the delaying and reversing unit 3022.

Outputting the clock reset pulse signal CDR reset by the processing module 302 when the reset control signal is changed from the initial state to the jumping state specifically includes the following steps.

The reset control signal Reset is outputted by the processing unit 3021.

The reset control signal Reset is delayed for a preset period of time by the delaying and reversing unit 3022 and is performed by a reverse operation by the delaying and reversing unit 3022 to obtain the delayed and reversed reset control signal Delay.

A corresponding logic operation is performed by the logic gate unit 3023 according to the reset control signal Reset and the delayed and reversed reset control signal Delay, and the clock reset pulse signal CDR reset is outputted when the reset control signal is reversed from the initial state to the jumping state, where a pulse width of the clock reset pulse signal CDR reset is a preset duration.

Based on the above-mentioned embodiment, refer to FIG. 6. The processing unit 3021 includes a detecting sub-unit 30211 and a recovering sub-unit 30212 which are connected to each other.

After the pulse of the clock reset pulse signal CDR reset ends and before the reset control signal Reset is recovered from the jump state to the initial state, recovering the reset control signal Reset specifically includes the following steps.

A state of the reset control signal Reset and a state of the clock reset pulse signal CDR reset are detected by the detection unit 30211.

The reset control signal Reset is recovered from the jumping state to the initial state by the recovering sub-unit 30212 after the pulse of the clock reset pulse signal CDR reset ends and before the reset control signal Reset is recovered from the jump state to the initial state.

Based on the same inventive concept, one embodiment of the present disclosure further provides a display panel, which includes at least one timing controller described in any one of the above-mentioned embodiments. The display panel and the timing controller have the same structure and beneficial effect. The timing controller is described in detail in the above-mentioned embodiments, and thus the display panel is not repeated herein.

Finally, it should be emphasized that with upgrading of consumption and technological development, the sizes of display panels are getting larger and higher, and the specifications are getting higher and higher. Currently, one timing controller chip cannot satisfy demands of a high-end product due to a high resolution and a high refresh rate. Accordingly, two or more timing controller chips are needed. Whether clock systems of timing controllers are synchronized is particularly important for the stability and reliability of the display panel. Therefore, for one or more timing controllers included in the display panel, when the clock of one of the timing controllers is not synchronized with the system, it is necessary to recover the clock of the timing controller, thereby keeping the clocks of all timing controllers to be synchronized.

It should be understood that those skilled in the art can make equivalent replacements or variations according to the technical solutions and inventive concepts of the present disclosure. All the variations or replacements shall fall with the scope of the appended claims.

What is claimed is:

1. A timing controller, comprising a detecting module, a processing module, and a clock data recovering module which are sequentially connected;

wherein the detecting module is configured to output a reset control signal in an initial state in response to a normal working condition of the timing controller and configured to output the reset control signal in a jumping state in response to an abnormal working condition of the timing controller;

the processing module is configured to generate a clock reset pulse signal according to the reset control signal in the jumping state and configured to recover the reset control signal from the jumping state to the initial state after a pulse of the clock reset pulse signal; and the clock data recovering module is configured to recover a clock of the timing controller according to the clock reset pulse signal, wherein the detecting module comprises a detecting unit and a reset unit which are connected to each other;

the detection unit is configured to detect a working state of the timing controller and configured to output the reset control signal in the initial state when the timing controller is working normally; and the reset unit is configured to reverse the reset control signal from the initial state to the jumping state when the detecting unit detects the abnormal working condition of the timing controller.

2. The timing controller of claim 1, wherein the processing module comprises a processing unit, a delaying and reversing unit, and a logic gate unit, an input terminal of the processing unit is connected to an output terminal of the detecting module, an output terminal of the processing unit is connected to an input terminal of the delaying and reversing unit and a first input terminal of the logic gate unit, and a second input terminal of the logic gate unit is connected to an output terminal of the delaying and reversing unit;

the processing unit is configured to detect a state of the reset control signal and a state of the clock reset pulse signal, and configured to recover the reset control signal from the jumping state to the initial state after a pulse of the clock reset pulse signal ends and before the reset control signal is recovered from the jumping state to the initial state;

the delaying and reversing unit is configured to delay the reset control signal for a preset period of time and configured to perform a reverse operation to obtain a delayed and reversed reset control signal; and the logic gate unit is configured to perform a corresponding logic operation according to the reset control signal and the delayed and reversed reset control signal and configured to output the clock reset pulse signal, wherein a pulse width of the clock reset pulse signal is a preset duration.

3. The timing controller of claim 2, wherein the processing unit comprises a detecting sub-unit and a recovering sub-unit;

the detecting sub-unit is configured to detect the state of the reset control signal and the state of the clock reset pulse signal; and the recovering sub-unit is configured to recover the reset control signal from the jumping state to the initial state after the detecting sub-unit detects that the pulse of the clock reset pulse signal ends and before the detecting sub-unit detects that the reset control signal is recovered from the jump state to the initial state.

4. The timing controller of claim 2, wherein a voltage level of the reset control signal in the initial state is a high voltage level, a voltage level of the reset control signal in the jumping state is a low voltage level, and a logic gate unit of the processing module is an OR gate.

5. The timing controller of claim 2, wherein a voltage level of the reset control signal in the initial state is a low voltage level, a voltage level of the reset control signal in the jumping state is a high voltage level, and a logic gate unit of the processing module is an AND gate.

6. A clock reset method of a timing controller, wherein the timing controller comprises a detecting module, a processing module, and a clock data recovering module which are sequentially connected, the clock reset method comprises:

outputting a reset control signal in an initial state the detecting module in response to a normal working condition of the timing controller, and outputting the reset control signal in a jumping state the detecting module in response to an abnormal working condition of the timing controller;

generating a clock reset pulse signal by the processing module according to the reset control signal in the jumping state, and recovering the reset control signal from the jumping state to the initial state by the processing module in response to an end of a pulse of the clock reset pulse signal; and recovering a clock of the timing controller by the clock data recovering module according to the clock reset pulse signal.

7. The clock reset method of the timing controller of claim 6, wherein the processing module comprises a processing unit, a delaying and reversing unit, and a logic gate unit, an input terminal of the processing unit is connected to an output terminal of the detecting module, an output terminal of the processing unit is connected to an input terminal of the delaying and reversing unit and a first input terminal of the logic gate unit, and a second input terminal of the logic gate unit is connected to an output terminal of the delaying and reversing unit;

the generating the clock reset pulse signal by the processing module according to the reset control signal in the jumping state comprises:

outputting the reset control signal by the processing unit;

delaying the reset control signal for a preset period of time by the delaying and reversing unit, and performing a reverse operation on reset control signal by the delaying and reversing unit to obtain a delayed and reversed reset control signal; and performing a corresponding logic operation by the logic gate unit according to the reset control signal and the delayed and reversed reset control signal, and outputting the clock reset pulse signal when the reset control signal is reversed from the initial state to the jumping state, where a pulse width of the clock reset pulse signal is a preset duration.

8. The clock reset method of the timing controller of claim 6, wherein the processing unit comprises a detecting sub-unit and a recovering sub-unit which are connected to each other;

the recovering the reset control signal from the jumping state to the initial state by the processing module in response to the end of the pulse of the clock reset pulse signal comprises:

detecting a state of the reset control signal and a state of the clock reset pulse signal by the detection unit; and recovering the reset control signal from the jumping state to the initial state by the recovering sub-unit after the pulse of the clock reset pulse signal ends and before the reset control signal is recovered from the jump state to the initial state.

9. The clock reset method of the timing controller of claim 7, wherein a voltage level of the reset control signal in the initial state is a high voltage level, a voltage level of the reset control signal in the jumping state is a low voltage level, and a logic gate unit of the processing module is an OR gate.

10. The clock reset method of the timing controller of claim 7, wherein a voltage level of the reset control signal in the initial state is a low voltage level, a voltage level of the reset control signal in the jumping state is a high voltage level, and a logic gate unit of the processing module is an AND gate.

11. A display panel, comprising at least one timing controller, wherein the timing controller, comprising a detecting module, a processing module, and a clock data recovering module which are sequentially connected;

wherein the detecting module is configured to output a reset control signal in an initial state in response to a normal working condition of the timing controller and configured to output the reset control signal in a jumping state in response to an abnormal working condition of the timing controller;

the processing module is configured to generate a clock reset pulse signal according to the reset control signal in the jumping state and configured to recover the reset control signal from the jumping state to the initial state after a pulse of the clock reset pulse signal; and the clock data recovering module is configured to recover a clock of the timing controller according to the clock reset pulse signal, wherein the detecting module comprises a detecting unit and a reset unit which are connected to each other;

the detection unit is configured to detect a working state of the timing controller and configured to output the reset control signal in the initial state when the timing controller is working normally; and the reset unit is configured to reverse the reset control signal from the initial state to the jumping state when the detecting unit detects the abnormal working condition of the timing controller.

12. The display panel of claim 11, wherein the processing module comprises a processing unit, a delaying and reversing unit, and a logic gate unit, an input terminal of the processing unit is connected to an output terminal of the detecting module, an output terminal of the processing unit is connected to an input terminal of the delaying and reversing unit and a first input terminal of the logic gate unit, and a second input terminal of the logic gate unit is connected to an output terminal of the delaying and reversing unit;

the processing unit is configured to detect a state of the reset control signal and a state of the clock reset pulse signal, and configured to recover the reset control signal from the jumping state to the initial state after a pulse of the clock reset pulse signal ends and before the reset control signal is recovered from the jumping state to the initial state;

the delaying and reversing unit is configured to delay the reset control signal for a preset period of time and configured to perform a reverse operation to obtain a delayed and reversed reset control signal; and the logic gate unit is configured to perform a corresponding logic operation according to the reset control signal and the delayed and reversed reset control signal and configured to output the clock reset pulse signal, wherein a pulse width of the clock reset pulse signal is a preset duration.

13. The display panel of claim 11, wherein the processing unit comprises a detecting sub-unit and a recovering sub-unit;

the detecting sub-unit is configured to detect the state of the reset control signal and the state of the clock reset pulse signal; and the recovering sub-unit is configured to recover the reset control signal from the jumping state to the initial state after the detecting sub-unit detects that the pulse of the clock reset pulse signal ends and before the detecting sub-unit detects that the reset control signal is recovered from the jump state to the initial state.

14. The display panel of claim 12, wherein a voltage level of the reset control signal in the initial state is a high voltage level, a voltage level of the reset control signal in the jumping state is a low voltage level, and a logic gate unit of the processing module is an OR gate.

15. The display panel of claim 12, wherein a voltage level of the reset control signal in the initial state is a low voltage level, a voltage level of the reset control signal in the jumping state is a high voltage level, and a logic gate unit of the processing module is an AND gate.

* * * * *